US008256338B1

(12) United States Patent
Kirchner et al.

(10) Patent No.: US 8,256,338 B1
(45) Date of Patent: Sep. 4, 2012

(54) WEAPON AND WEAPON STATION SYSTEM AND METHOD FOR LOADING, TESTING, TARGETING, AND LAUNCHING A WEAPON

(75) Inventors: Richard Kirchner, Ridgecrest, CA (US); Mallory Boyd, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 349 days.

(21) Appl. No.: 12/652,869

(22) Filed: Jan. 6, 2010

(51) Int. Cl.

| | |
|---|---|
| ***F42B 15/00*** | (2006.01) |
| ***F42B 15/01*** | (2006.01) |
| ***F41F 3/04*** | (2006.01) |
| ***F41F 3/052*** | (2006.01) |

(52) U.S. Cl. ..... 89/1.8; 89/1.805; 89/1.806; 89/1.812; 89/28.05

(58) Field of Classification Search ..... 89/1.8, 89/1.805, 1.806, 1.812, 28.05
See application file for complete search history.

(56) References Cited

U.S. PATENT DOCUMENTS

| | | | | |
|---|---|---|---|---|
| 3,090,197 | A * | 5/1963 | Lapp et al. | 60/223 |
| 3,814,017 | A * | 6/1974 | Backstein et al. | 102/215 |
| 4,653,211 | A * | 3/1987 | Brede et al. | 42/84 |
| 5,034,686 | A * | 7/1991 | Aspelin | 324/537 |
| 6,415,211 | B1 * | 7/2002 | Kotlow | 73/167 |
| 6,439,097 | B1 * | 8/2002 | Loving | 89/1.814 |
| 7,647,870 | B2 * | 1/2010 | Pokryvailo et al. | 102/202.8 |
| 2004/0069135 | A1 * | 4/2004 | Fowler | 89/1.805 |
| 2008/0105113 | A1 * | 5/2008 | Schneider et al. | 89/1.812 |

* cited by examiner

*Primary Examiner* — Bret Hayes
(74) *Attorney, Agent, or Firm* — Christopher L. Blackburn

(57) ABSTRACT

A system that provides wireless power transfer between a weapon and a platform. A method for loading, testing, targeting, and launching a weapon.

5 Claims, 6 Drawing Sheets

WEAPON AND WEAPON STATION SYSTEM AND METHOD FOR LOADING, TESTING, TARGETING, AND LAUNCHING A WEAPON

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to a weapon and weapon station system and method for loading, testing, targeting, and launching a weapon.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF THE EMBODIMENTS OF THE INVENTION

Figure 1:
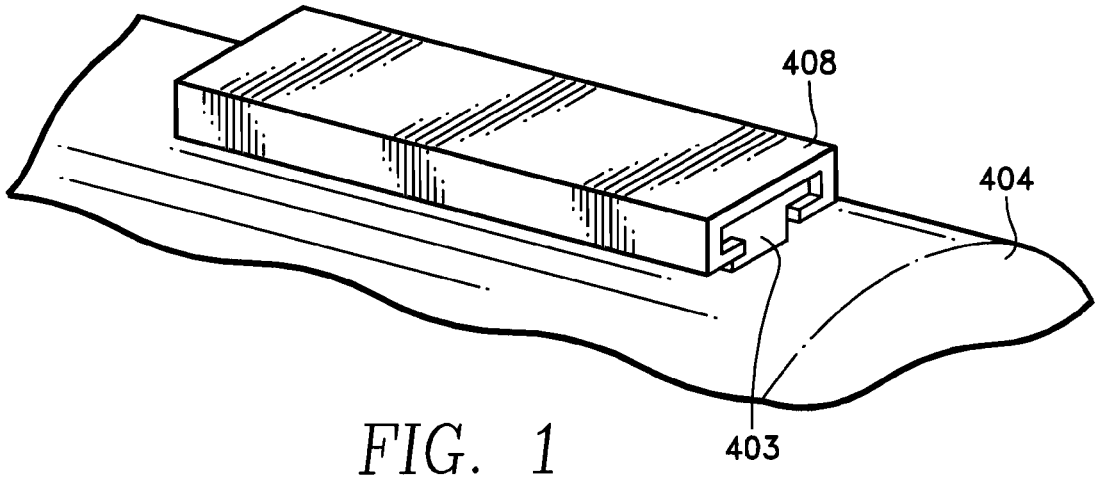
FIG. 1 is a perspective view that illustrates a portion of a general weapon, a general weapon rail, and a general platform rail, in accordance with the principles of the invention.

The invention generally relates to a weapon and weapon station, and method for loading, testing, targeting, and launching a weapon. Note that dashed lines in the in FIG. 1A indicate optional steps.

The method includes associating a first inductive power coupler (FIGS. 2-7, 410) with a platform rail (shown generally in FIGS. 1-7, 408) of the platform of the weapon station. The first inductive power coupler (FIGS. 2-7, 410) can be associated with a platform rail (FIGS. 1-7, 408) on a platform of a weapon station using any known means. In one embodiment, the first inductive power coupler (FIGS. 2-7, 410) is associated with a platform rail (FIGS. 1-7, 408) on a platform of a weapon station by locating the sensor in a cavity within the platform rail 408. In another embodiment, the first inductive power coupler (FIGS. 2-7, 410) is associated with a platform rail (FIGS. 1-7, 408) on a platform of a weapon station using a retainer.

A second inductive power coupler (FIGS. 2-7, 412) is associated with the weapon rail (FIGS. 4-7, 403) such that a change in current flow through the first inductive power coupler (FIGS. 2-7, 410) induces a voltage across the ends of the second inductive power coupler (FIGS. 2-7, 412) when the weapon (FIGS. 1-7 and 9, 404) is loaded onto the weapon station (FIG. 8A, 108), i.e., the first inductive power coupler (FIGS. 2-7, 410) is electrically associated with the second inductive power coupler (FIGS. 2-7, 412).

The second inductive power coupler (FIGS. 2-7, 412) can be associated with a platform rail (FIGS. 1-7, 408) on a platform of a weapon station using any known means. In one embodiment, the second inductive power coupler (FIGS. 2-7, 412) is associated with the weapon rail (FIGS. 1-7, 403) by locating the coupler in a cavity within the weapon rail (FIGS. 1-7, 403). In other embodiment, the second inductive power coupler (FIGS. 2-7, 412) is associated with the weapon rail (FIGS. 1-7, 403) using a retainer.

In some embodiments of the invention, the method includes detecting that the weapon has been loaded onto the weapon station by detecting a change in current flow through the first inductive power coupler (FIGS. 2-7, 410).

Figure 8A:
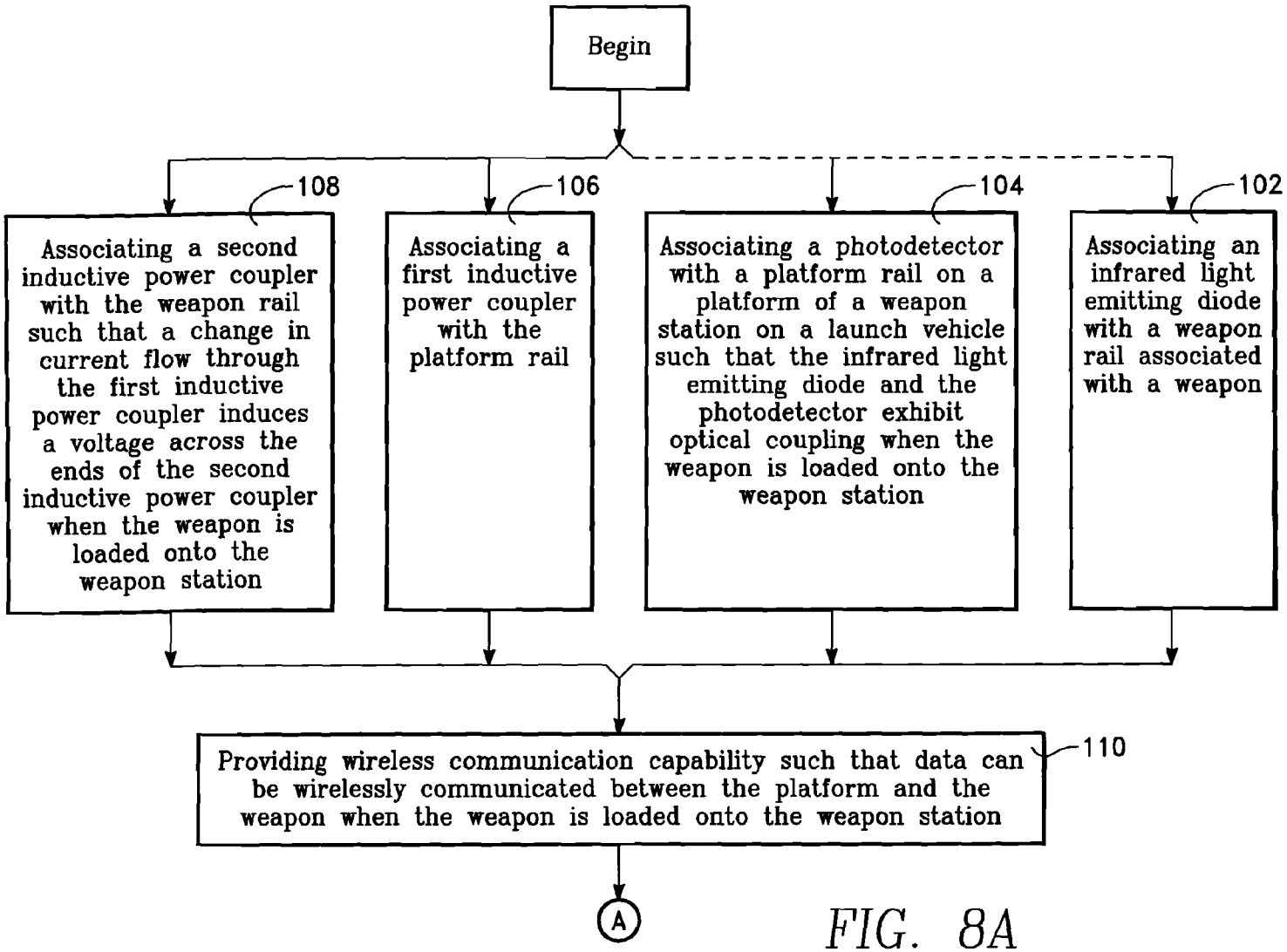
FIGS. 8A-8C combine to form a single flow chart that diagrams one embodiment of a method in accordance with the principles of the invention.

In another embodiment, the weapon is detected to have been loaded onto the weapon station using an optical coupling (FIGS. 4-7, 402 and 406). A method performed in accordance with the principles of this embodiment includes associating an infrared light emitting diode (FIGS. 4-7, 402) with a weapon rail (FIGS. 1-7, 403) associated with a weapon (FIGS. 1-7 and 9, 404) (FIG. 8A, 102). In this embodiment, the infrared light emitting diode (FIGS. 4-7, 402) can be associated with a weapon rail (FIGS. 1-7, 403) associated with a weapon (FIGS. 1-7 and 9, 404) using any known means. In one embodiment, the infrared light emitting diode (FIGS. 4-7, 402) is associated with a weapon rail (FIGS. 1-7, 403) associated with a weapon (FIGS. 1-7 and 9, 404) by locating the sensor in a cavity within the weapon rail (FIGS. 1-7, 403); in other embodiments, the infrared light emitting diode (FIGS. 4-7, 402) is associated with a weapon rail (FIGS. 1-7, 403) associated with a weapon (FIGS. 1-7 and 9, 404) using a retainer. In this embodiment, a photodetector (FIGS. 4-7, 406) is associated with a platform rail (FIGS. 4-7, 408) on a platform of a weapon station on a launch vehicle such that when the weapon (FIGS. 1-7 and 9, 404) is loaded onto the platform rail (FIGS. 1-7, 408), the infrared light emitting diode (FIGS. 4-7, 402) and the photodetector (FIGS. 4-7, 406) exhibit optical coupling FIG. 8A, 104. The wavelength responses of the infrared light emitting diode (FIGS. 4-7, 402) and photodetector (FIGS. 4-7, 406) are ideally tailored to be as identical as possible to permit the highest measure of coupling possible. In another embodiment, other circuitry—for example an output amplifier—is integrated into the optical coupling package (FIGS. 4-7, 402 and 406). The photodetector (FIGS. 4-7, 406) can be associated with a platform rail (FIGS. 1-7, 408) on a platform of a weapon station using any known means. In one embodiment, the photodetector (FIGS. 4-7, 406) is associated with a platform rail (FIGS. 1-7, 408) on a platform of a weapon station by locating the sensor in a cavity within the platform rail (FIGS. 1-7, 408). In another embodiment, the photodetector (FIGS. 4-7, 406) is associated with a platform rail (FIGS. 1-7, 408) on a platform of a weapon station using a retainer.

Some embodiments of the invention include providing wireless communication capability such that data can be wirelessly communicated between the platform and the weapon (FIGS. 1-7 and 9, 404) when the weapon (FIGS. 1-7 and 9, 404) is loaded onto the weapon station (FIG. 8A, 110).

Figure 9:
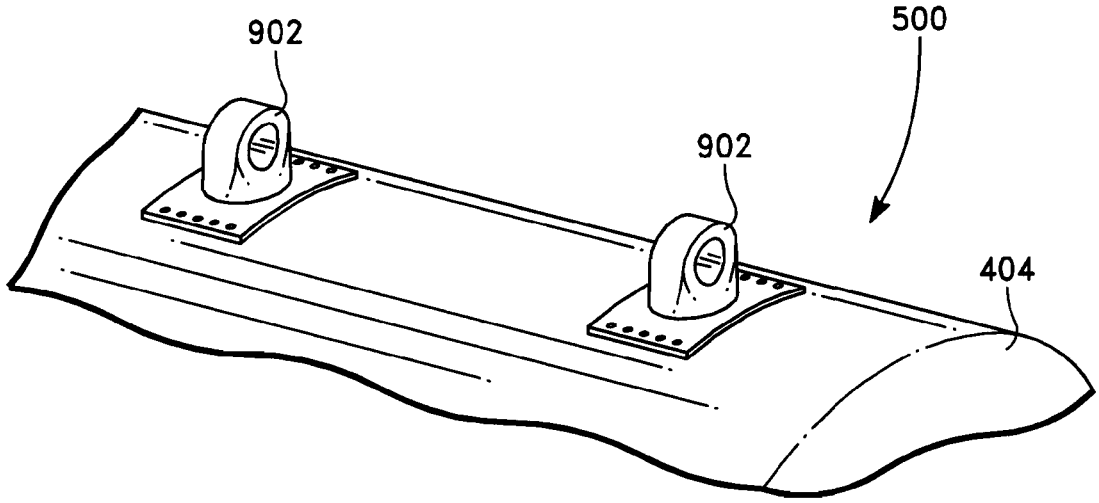
FIG. 9 is a perspective view that generally illustrates a hook and lug mounted weapon, in accordance with the principles of the invention.
Figure 10A:
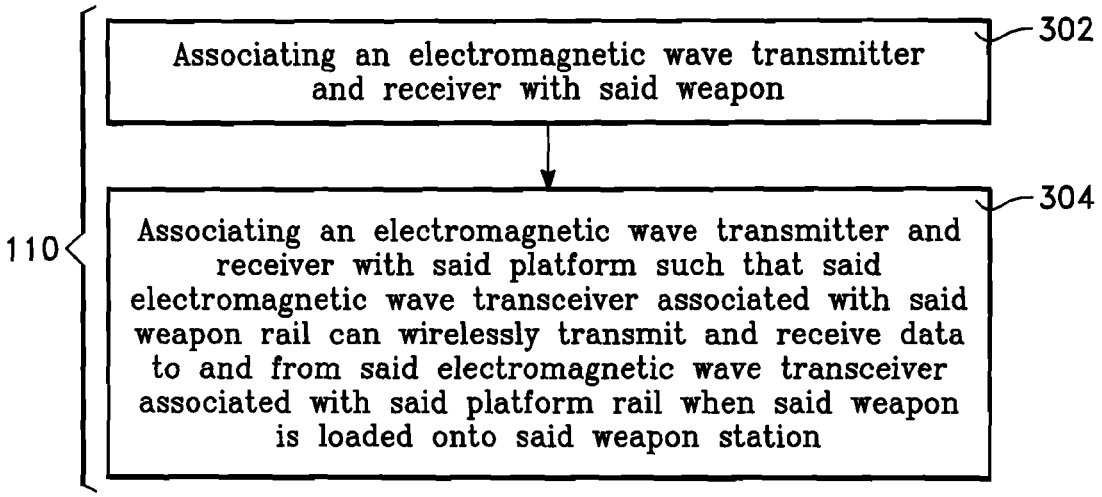
FIG. 10A is a flow chart that diagrams a portion of one embodiment of a method in accordance with the principles of the invention.

In one embodiment, the wireless communication between the platform and the weapon (FIGS. 1-7 and 9, 404) is established via radio frequency communication using a stand alone wireless device, including, for example, bluetooth and Wi-Fi IEEE 802.11 or any Wi-Fi technology that is developed. With reference to FIGS. 1, 3, 4, and 5, where wireless communication capability between the platform and the weapon is provided using a stand-alone wireless device, the method includes associating an electromagnetic wave transmitter and receiver (FIGS. 6-7, 414) with the weapon (FIGS. 1-7 and 9, 404), (FIG. 10A, 302). In this embodiment, an electromagnetic wave transmitter and receiver (416 in FIGS. 6,7) is associated with the platform such that the electromagnetic wave transmitter and receiver associated with the weapon (FIGS. 1-7 and 9, 404) (FIGS. 6-7, 414), can wirelessly transmit and receive data to and from the electromagnetic wave transmitter and receiver associated with the platform (416 in FIGS. 6,7) when the weapon (FIGS. 1-7 and 9, 404) is loaded onto the weapon station (FIG. 10A, 304). The transmitters and receivers (FIGS. 6-7, 414, 416) can be associated with the weapon rail or platform using any known means. In other embodiments where hook and lug (FIG. 9, 902) retained weapon(s) (FIG. 9, 500) are used, and where data is wirelessly communicated using a stand-alone wireless device, the wireless communication capability between the platform and the weapon (FIG. 9, 404) could take place via devices associated with the hooks (not pictured) and lugs (FIG. 9, 902).

Figure 10B:
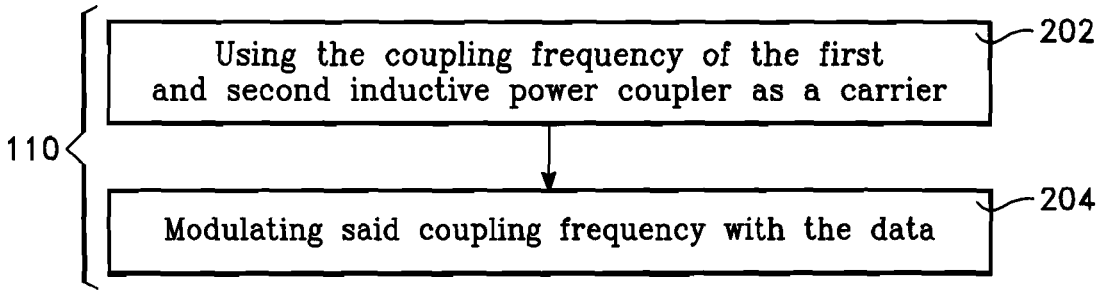
FIG. 10B is a flow chart that diagrams a portion of one embodiment of a method in accordance with the principles of the invention.

In another embodiment, with reference to FIGS. 2-5 wireless communication between the platform and the weapon (FIG. 8A, 110), (FIGS. 1-7 and 9, 404) is provided via the magnetic power coupler by using the coupling frequency as a carrier (FIG. 10B, 202), and modulating the coupling frequency with the data 204, thus eliminating the need for a stand-alone wireless receiver.

Figure 2:
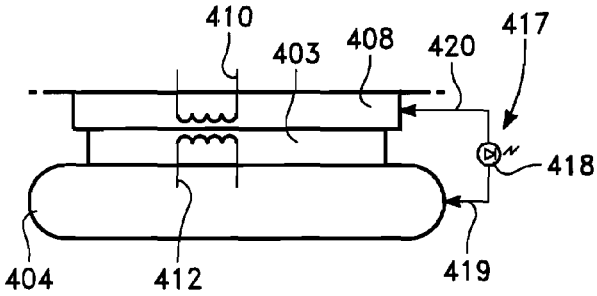
FIG. 2 is a side perspective view that illustrates one embodiment of a system in accordance with the principles of the invention. The figure generally illustrates an inductive power coupling system located within a weapon rail and platform rail. The figure also generally illustrates a laser safety initiation system.
Figure 3:
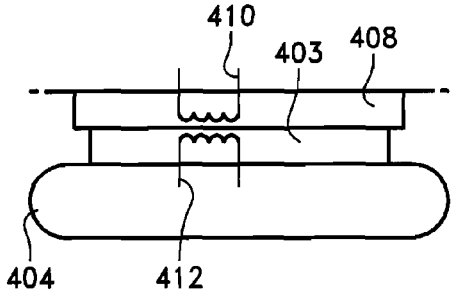
FIG. 3 is a side perspective view that illustrates one embodiment of a system in accordance with the principles of the invention. The figure generally illustrates an inductive power coupling system located within a weapon rail and platform rail.
Figure 4:
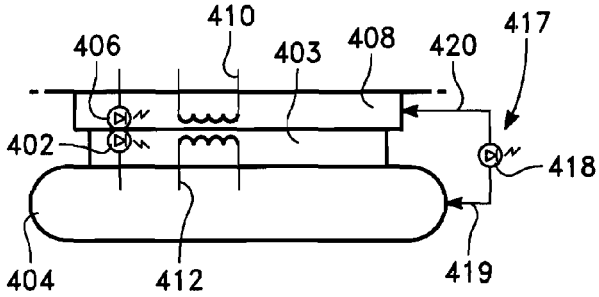
FIG. 4 is a side perspective view that illustrates one embodiment of a system in accordance with the principles of the invention. The figure generally illustrates an inductive power coupling system located within a weapon rail and platform rail. The figure also generally illustrates an optical coupling system located within a weapon rail and a platform rail. The figure also generally illustrates a laser safety initiation system.
Figure 5:
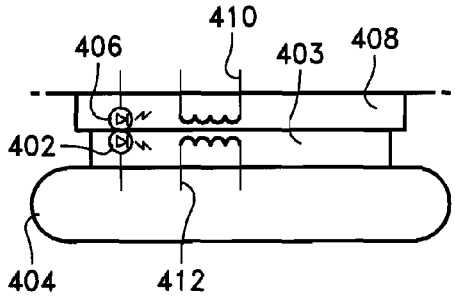
FIG. 5 is a side perspective view that illustrates one embodiment of a system in accordance with the principles of the invention. The figure generally illustrates an inductive power coupling system located within a weapon rail and platform rail. The figure also generally illustrates an optical coupling system located within a weapon rail and a platform rail.
Figure 6:
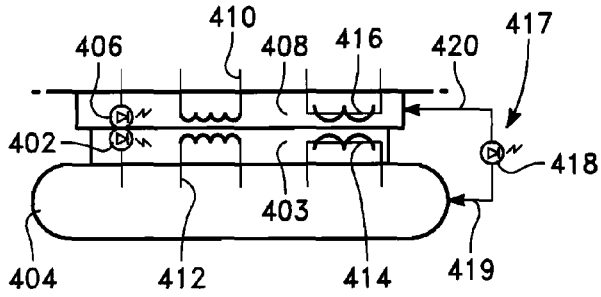
FIG. 6 is a side perspective view that illustrates one embodiment of a system in accordance with the principles of the invention. The figure generally illustrates an inductive power coupling system located within a weapon rail and platform rail. The figure also generally illustrates an optical coupling system located within a weapon rail and a platform rail. The figure also generally illustrates a laser safety initiation system. The figure also generally illustrates a stand alone wireless communication system located within a platform rail and a weapon rail.
Figure 7:
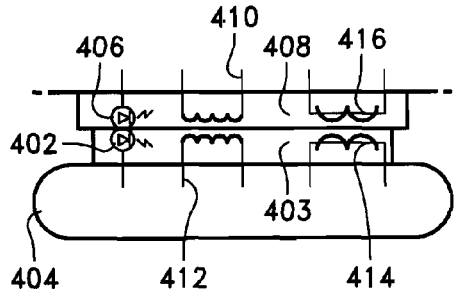
FIG. 7 is a side perspective view that illustrates one embodiment of a system in accordance with the principles of the invention. The figure generally illustrates an inductive power coupling system located within a weapon rail and platform rail. The figure also generally illustrates an optical coupling system located within a weapon rail and a platform rail. The figure also generally illustrates a stand alone wireless communication system located within a platform rail and a weapon rail.

With reference to FIGS. 2, 4, 6, in some embodiments, a laser safety initiation system 417 including a laser (a diode emitter) and two fiber optic cables 419 and 420 are included that serve as a motor initiator.

In this embodiment, a first fiber optic cable 420 runs from a laser (not pictured) located on the platform 408 to a fiber coupler 418. A second fiber optic cable 419 runs from the fiber coupler 418 and feeds into the motor nozzle (not pictured), delivering laser light to the initiator, igniting it. After the rocket motor is ignited, the heat from the motor severs the fiber optic connection to the motor nozzle 419, leaving the weapon 404 free of any electrical connection to the platform 408. The first fiber optic cable 420 is available for reuse on subsequent firings.

Figure 8B:
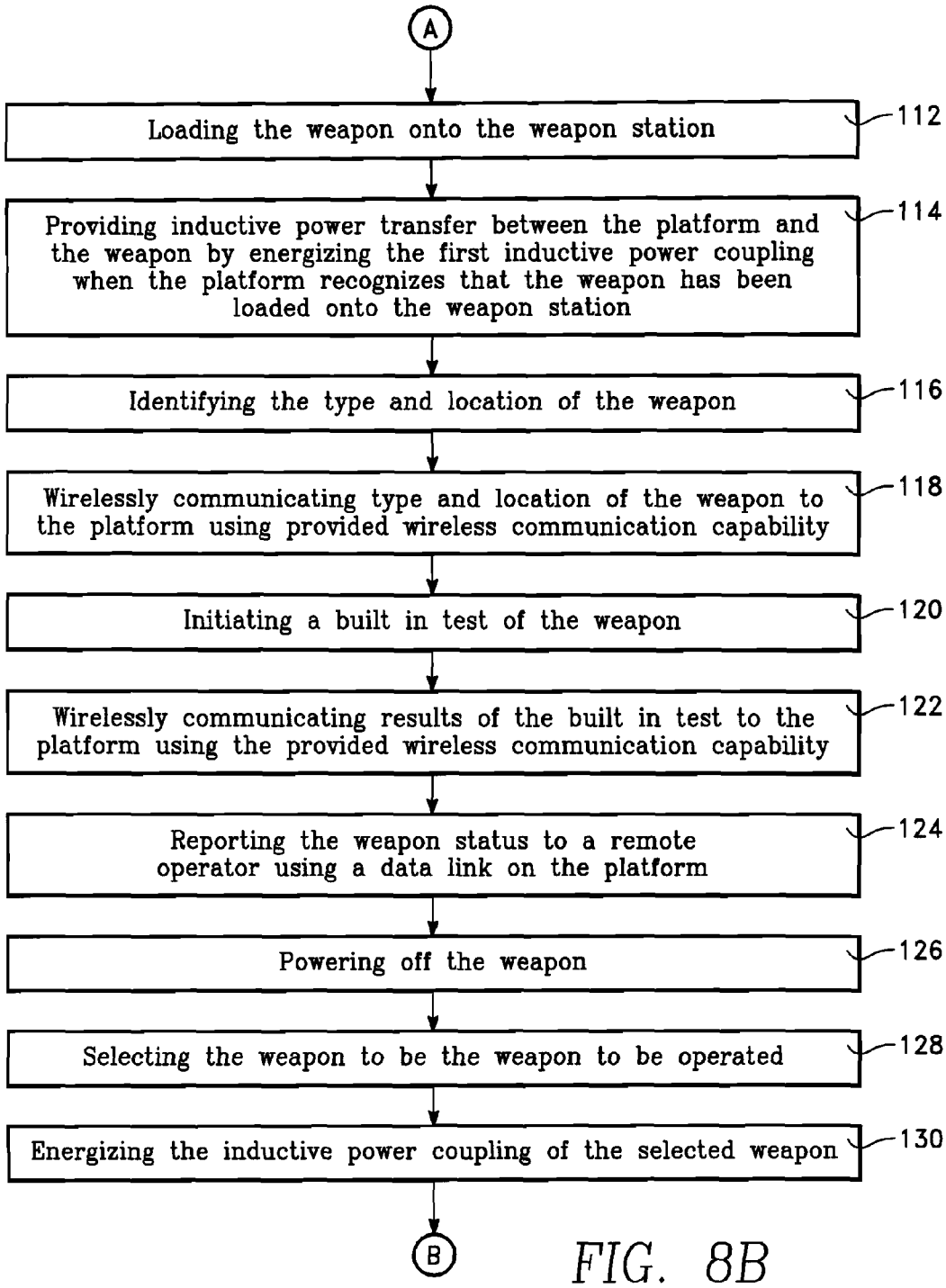

Some embodiments of the invention include loading the weapon (FIGS. 1-7 and 9, 404) onto the weapon station (FIG. 8B, 112).

Some embodiments of the invention include providing inductive power transfer between the platform and the weapon (FIGS. 1-7 and 9, 404) by energizing the first inductive power coupler (FIGS. 2-7, 410) when the platform recognizes that the weapon (FIGS. 1-7 and 9, 404) has been loaded onto the weapon station (FIG. 8B, 114). The first inductive power coupler (FIGS. 2-7, 410) can be energized using any known means as long as the inductive power transfer between the first inductive power coupler (FIGS. 2-7, 410) and second inductive power coupler (FIGS. 2-7, 412) provides sufficient power to the weapon (FIGS. 1-7 and 9, 404).

In some embodiments, the type of the weapon is identified using the data link; the location of the weapon (FIGS. 1-7 and 9, 404) is identified (FIG. 8B, 116) using the optical coupling (in embodiments that include an optical coupler) or the inductive power coupling.

Some embodiments of the invention include wirelessly communicating the type and location of the weapon (FIGS. 1-7 and 9, 404) to the platform using the provided wireless communication capability between the platform and the weapon (FIG. 8B, 118).

In some embodiments, a built in test of the weapon (FIGS. 1-7 and 9, 404) is initiated (FIG. 8B, 120).

Some embodiments of the invention include wirelessly communicating results of the built in test to the platform using the provided wireless communication capability between the platform and the weapon (FIG. 8B, 122).

Some embodiments of the invention include reporting the status of the weapon (FIGS. 1-7 and 9, 404) to a remote operator using a data link located on the platform (FIG. 8B, 124).

Some embodiments of the invention include powering off the weapon (FIGS. 1-7 and 9, 404) (FIG. 8B, 126). Many power sources can be utilized with embodiments of the invention that are known in the art including, but not limited to, AC/DC, solar, and batteries. The power source can be separate or taken from the vehicle in which the platform is associated.

Some embodiments of the invention selecting the weapon (FIGS. 1-7 and 9, 404) to be the weapon (FIGS. 1-7 and 9, 404) to be operated (FIG. 8B, 128).

Some embodiments of the invention include energizing the first inductive power coupler of the weapon (FIGS. 1-7 and 9, 404), thereby inductively transferring power to the weapon (FIGS. 1-7 and 9, 404) (FIG. 8B, 130).

Figure 8C:
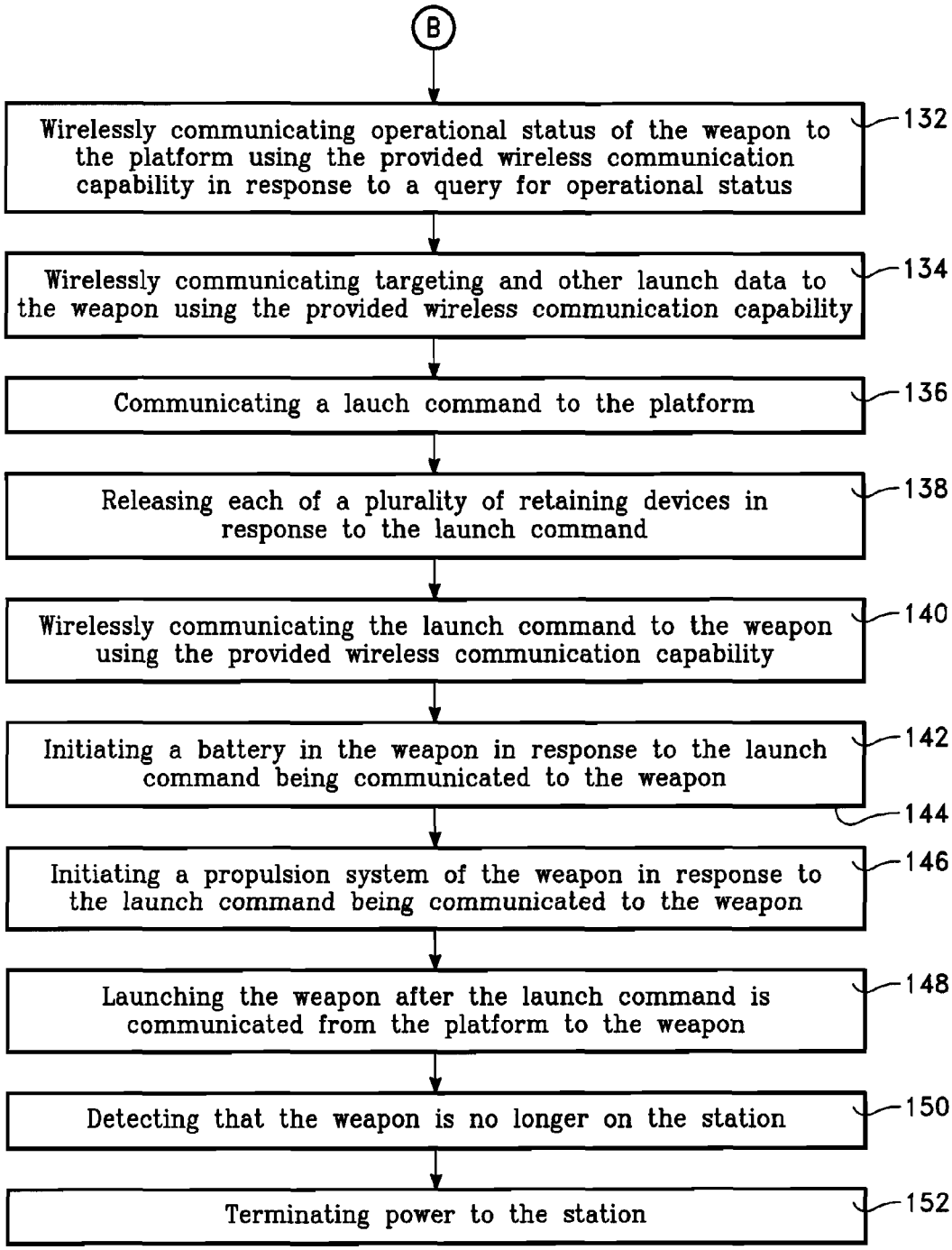

In some embodiments, the operational status of the weapon (FIGS. 1-7 and 9, 404) is wirelessly communicated to the platform in response to a query for operational status using the provided wireless communication capability between the platform and the weapon (FIG. 8C, 132).

Some embodiments of the invention include wirelessly transferring and/or communicating targeting and other launch data to the (FIGS. 1-7 and 9, 404) using the provided wireless communication capability between the platform and the weapon (FIG. 8C, 134).

Some embodiments of the invention include communicating a launch command to the platform (FIG. 8C, 136).

Some embodiments of the invention releasing each of a plurality of retaining devices in response to the launch command (FIG. 8C, 138).

Some embodiments of the invention include wirelessly communicating the launch command to the weapon (FIGS. 1-7 and 9, 404) using the provided wireless communication capability between the platform and the weapon (FIG. 8C, 140).

Some embodiments of the invention include initiating a battery in the weapon (FIGS. 1-7 and 9, 404) in response to the launch command being communicated to the weapon (FIGS. 1-7 and 9, 404) using the provided wireless communication capability between the platform and the weapon (FIG. 8C, 142).

Some embodiments of the invention include initiating a propulsion system of the weapon (FIGS. 1-7 and 9, 404) in response to the launch command being communicated to the weapon (FIGS. 1-7 and 9, 404) using the provided wireless communication capability between the platform and the weapon (FIG. 8C, 146).

Some embodiments of the invention include launching the weapon (FIGS. 1-7 and 9, 404) after the launch command is communicated from the platform to the weapon (FIGS. 1-7 and 9, 404) using the provided wireless communication capability between the platform and the weapon (FIG. 8C, 148).

Some embodiments of the invention include detecting that the weapon (FIGS. 1-7 and 9, 404) is no longer on the station (FIG. 8C, 150). Where an optical coupling is not used to detect whether the weapon is on the station (see FIG. 8A, 102, 104) the method includes detecting that the weapon has been loaded onto the weapon station by detecting a change in current flow through the first inductive power coupler (FIGS. 2-7, 410). Where optical coupling is used to detect whether the weapon is on the station (see FIG. 8A, 102, 104), the weapon is detected to no longer be on the weapon station when the infrared light emitting diode (FIGS. 4-7, 402) and the photodetector (FIGS. 4-7, 406) do not exhibit optical coupling.

Some embodiments of the invention include terminating power to the station after it has been detected that the weapon is no longer on the station (FIG. 8C, 152).

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method for loading, testing, targeting, and launching a weapon, comprising:

providing power to a weapons station;

associating an infrared light emitting diode with a weapon rail associated with a weapon;

associating a photodetector with a platform rail on a platform of a weapon station on a launch vehicle such that the infrared light emitting diode and the photodetector exhibit optical coupling when the weapon is loaded onto the platform rail;

associating a first inductive power coupler with the platform rail;

associating the first inductive power coupler with a second inductive power coupler;

associating the second inductive power coupler with the weapon rail such that a change in current flow through the first power coupler induces a voltage across the ends of the second power coupler when the weapon is loaded onto the weapon station;

providing wireless communication capability such that data can be wirelessly communicated between the platform and the weapon when the weapon is loaded onto the weapon station;

loading the weapon onto the weapon station;

energizing the first inductive power coupler when the platform recognizes that the weapon has been loaded onto the weapon station;

identifying the type and location of the weapon;

communicating the type and location of the weapon to the platform using wireless data transfer;

initiating a built in test of the weapon;

communicating results of the built in test to the platform using the wireless data transfer;

reporting weapon status to a remote operator using a datalink on the platform;

powering off the weapon;

selecting the weapon to be the weapon to be operated;

energizing the inductive power coupling of the selected weapon;

communicating operational status of the weapon to the platform using the wireless data transfer in response to a query for operational status;

communicating targeting and other launch data to the weapon using the wireless data transfer;

communicating a launch command to the platform;

releasing each of a plurality of retaining devices in response to the launch command;

communicating the launch command to the weapon using the wireless data transfer;

initiating a battery in the weapon in response to the launch command being communicated to the weapon using the wireless data transfer;

initiating a propulsion system of the weapon in response to the launch command being communicated to the weapon using the wireless data transfer;

communicating the launch command from the platform to the weapon using the wireless data transfer;

launching the weapon;

detecting that the weapon is no longer on the station; and terminating power to the station.

2. The method of claim 1, wherein the platform recognizes that the weapon has been loaded onto the platform when optical coupling between the infrared light emitting diode and the photodetector occurs.

3. The method of claim 1, wherein the detecting that the weapon is no longer on the station step comprises termination of optical coupling between the infrared light emitting diode and the photodetector.

4. The method of claim 1, wherein said providing wireless communication capability such that data can be wirelessly communicated between the platform and the weapon when the weapon is loaded onto the weapon station step comprises:

using a coupling frequency of the inductive power coupler as a carrier; and modulating the coupling frequency with data to be communicated.

5. The method of claim 1, wherein said providing wireless communication capability such that data can be wirelessly communicated between the platform and the weapon when the weapon is loaded onto the weapon station step comprises:

associating an electromagnetic wave transmitter and a receiver with the weapon; and associating an electromagnetic wave transmitter and the receiver with the platform such that the electromagnetic wave transmitter and receiver associated with the weapon can wirelessly transmit and receive data to and from the electromagnetic wave transmitter and receiver associated with the platform when the weapon is loaded onto the weapon station.

* * * * *